US007727337B2

(12) United States Patent
Sachdev et al.

(10) Patent No.: US 7,727,337 B2
(45) Date of Patent: Jun. 1, 2010

(54) SIMPLIFIED METHOD FOR CLEANING PRODUCTION TOOLS USED FOR METAL FORMING

(75) Inventors: Anil K. Sachdev, Rochester Hills, MI (US); Paul E. Krajewski, Sterling Heights, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 824 days.

(21) Appl. No.: 11/539,966

(22) Filed: Oct. 10, 2006

(65) Prior Publication Data

US 2008/0083426 A1 Apr. 10, 2008

(51) Int. Cl.

| | |
|---|---|
| ***B08B 3/12*** | (2006.01) |
| ***C23G 1/02*** | (2006.01) |
| ***C23G 1/08*** | (2006.01) |
| ***C23G 1/14*** | (2006.01) |
| ***C23G 1/19*** | (2006.01) |

(52) U.S. Cl. ..... 134/27; 134/2; 134/3; 134/6; 134/26; 134/28; 134/29; 134/41

(58) Field of Classification Search ..... 134/2, 134/26, 41, 3, 6, 27–29
See application file for complete search history.

(56) References Cited

U.S. PATENT DOCUMENTS

| | | | | |
|---|---|---|---|---|
| 3,033,710 | A * | 5/1962 | Hightower et al. | 134/1 |
| 4,064,061 | A * | 12/1977 | Henry | 15/104.93 |
| 4,482,469 | A * | 11/1984 | Plotze | 510/190 |
| 4,588,474 | A * | 5/1986 | Gross | 216/102 |
| 4,770,196 | A | 9/1988 | Osswald | |
| 4,998,428 | A * | 3/1991 | Rechenbach | 72/40 |
| 5,355,956 | A | 10/1994 | Restarick | |
| 2005/0244274 | A1 * | 11/2005 | Wustman et al. | 416/241 R |

* cited by examiner

*Primary Examiner*—Michael Kornakov
*Assistant Examiner*—Natasha Campbell
(74) *Attorney, Agent, or Firm*—Quinn Law Group, PLLC

(57) ABSTRACT

Chemical method of cleaning metallic residue from forming tools utilizing the application of a caustic material including base or mild acid to the tool for a short period of time. The caustic material is held in substantially fixed relation for a period of time to dislodge the metallic residue followed by neutralization or removal.

17 Claims, 2 Drawing Sheets

SIMPLIFIED METHOD FOR CLEANING PRODUCTION TOOLS USED FOR METAL FORMING

TECHNICAL FIELD

The present invention relates generally to a chemical method for cleaning stamping or other work piece deformation tools by removing locally adhered build-up of work piece metal.

BACKGROUND OF THE INVENTION

It is well known that steel tools used for extruding metals such as aluminum can collect substantial amounts of aluminum or other work piece metal within the cavities after the completion of the extrusion process. These tools are typically cleaned by immersing them in warm caustic solutions for several days to dissolve the aluminum without affecting the steel tooling. While this method works well for the aluminum extrusion industry, it is impractical with stamping tools due to the length of time required for cleaning and the relatively small amounts of aluminum and/or other metals remaining in localized regions on the stamping tools after use. Currently, tooling used for stamping at room temperature is hand wiped to remove buildup. An alternative approach is to cool the tool to room temperature and then polish with sandpaper and diamond paste. The problem with this approach is that some of the ferrous tooling material in the vicinity of the aluminum that is built up is also removed which can locally change dimensions or deformation conditions like friction, both of which are critical for part forming and dimensional control. Additionally, if the tool is coated for some desirable characteristics, there is a danger that some of this coating could get damaged or removed.

SUMMARY OF THE INVENTION

This invention is believed to provide advantages and alternatives over prior practices by providing a method of cleaning stamping and other metal forming tools which utilizes localized application of a solution of caustic character in the form of basic or mild acid compositions that only attack the buildup (depending on the metal being formed) to remove metal buildup within a few minutes. This avoids the necessity of taking the tool off line or applying aggressive shape-deforming treatments.

BRIEF DESCRIPTION OF THE DRAWINGS

The accompanying drawings which are incorporated in and which constitute a portion of this specification illustrate an exemplary practice according to the present invention wherein.

While embodiments of the invention have been illustrated and generally described above and will hereinafter be described in connection with certain potentially preferred procedures and practices, it is to be understood and appreciated that in no event is the invention to be limited to such embodiments and procedures as may be illustrated and described herein. On the contrary, it is intended that the present invention shall extend to all alternatives and modifications as may embrace the broad principles of the invention within the true spirit and scope thereof.

DETAILED DESCRIPTION

While the following description will be presented in terms of a stamping operation, it is to be understood that reference to such a stamping operation is intended to be illustrative only and that practice of the invention is in no way limited to stamping tools. To the contrary, it is contemplated and intended that the inventive cleaning practices may be equally applicable to any number of forming tools that apply controlled deformation to a work piece including cutting tools, extrusion tools and the like as will be well known to those of skill in the art.

Figure 1:
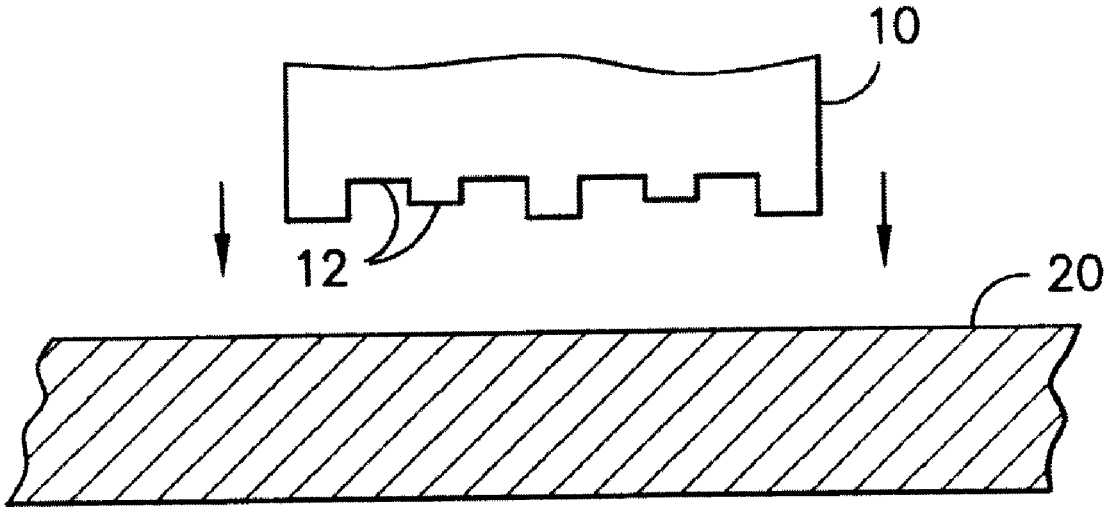
FIG. 1 is an exemplary cross sectional view of a stamping tool and a metal work piece prior to stamping.

Reference will now be made to the various drawings wherein to the extent possible, like elements are designated by corresponding reference numerals in the various views. In FIG. 1, a stamping tool 10 of tool steel or the like and a metal work piece 20 of a deformable metal such as aluminum or the like are illustrated prior to stamping. As will be appreciated, the stamping tool 10 has a contoured workface defining a pattern 12 of indentations and protrusions of varying size and shape. During the stamping operation the pattern across the stamping tool is pressed in relief across the work piece 20.

Figure 2:
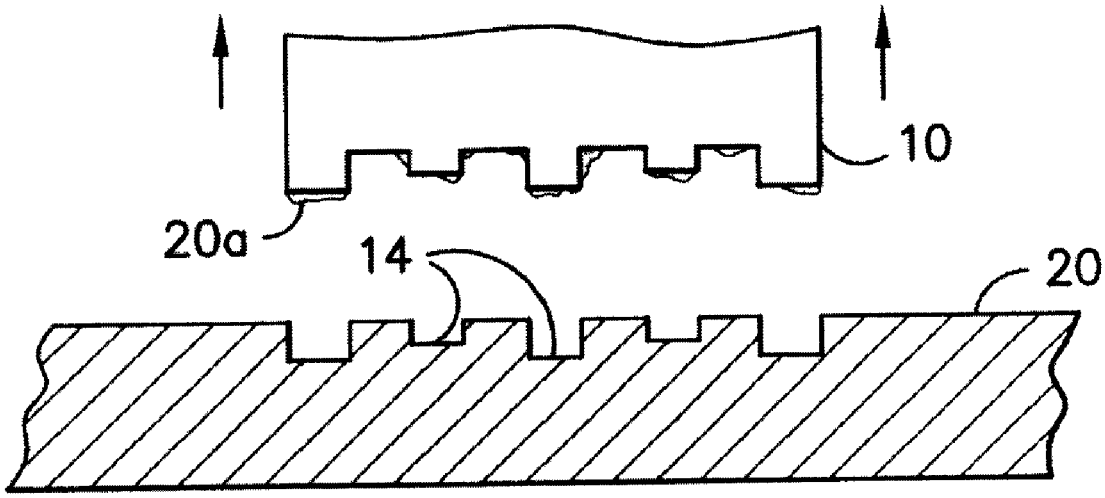
FIG. 2 is an exemplary cross sectional view of a stamping tool and a metal work piece after stamping.

FIG. 2 illustrates the stamping tool 10 and the metal work piece 20 subsequent to the stamping operation. As can be readily observed, following the stamping operation localized regions of small amounts of metal substrate residue 20*a* become adhered to the stamping tool. These deposits will normally build up over time so as to change of the profile of the stamping tool 10 and affect friction conditions that were optimized for forming.

Figure 3:
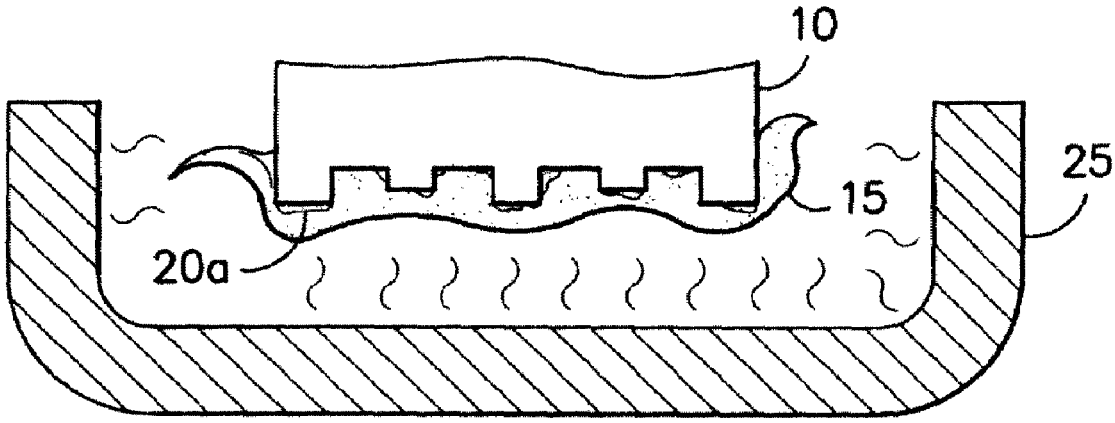
FIG. 3 is an exemplary cross sectional view of a stamping tool and a metal work piece with an applied cleaning composition.

FIG. 3 depicts the inventive method of cleaning the stamping tool 10. This method uses a solution of caustic material in the form of a base or mild acid that does not attack the tooling material, which can be either in the form of a gel or saturated onto a cloth 15. The gel or saturated cloth 15 is placed into contacting relation with critical areas of the stamping tool 10 which have localized regions of metal substrate residue buildup. After approximately 5 minutes of contact the gel is neutralized or wiped off or the saturated cloth is removed. The contact is preferably substantially static in nature with the gel or cloth 15 being held in a substantially fixed position so as to promote uninterrupted chemical reaction. To facilitate the cleaning action an optional ultrasonic vibration device 25 may be secured at least partially around the gel or saturated cloth 15 to promote loosening of the substrate residue 20*a*.

Figure 4:
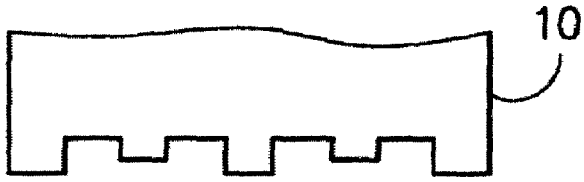
FIG. 4 illustrates a cleaned stamping tool.

FIG. 4 illustrates the cleaned stamping tool 10 in which the localized buildup of metal substrate residue 20*a* is no longer evident. The stamping tool requires no additional cleaning or polishing.

According to potentially preferred practices, the caustic material may be either basic or acidic in nature. By way of example only, and not limitation, exemplary caustic compositions include NaOH, KOH, acetic acid, phosphoric acid and chemicals with similar caustic properties, and any combination of such materials depending on the adhered material and the tooling material used. By way of example only, and not limitation one caustic material that has been found to be effective is a gel marketed under the trade designation DRANO®. In accordance with a particularly preferred practice, the cleaning operation may be performed at slightly elevated temperatures such as 50-100° C. in order to accelerate the reaction.

The present method is believed to be particularly beneficial for cleaning ferrous stamping tools with deposits from aluminum and aluminum alloy metal work pieces. However, the practice can also be applied to clean other tooling materials including ceramics and the like and other work piece metals that stick to such tooling including magnesium, titanium, zinc coatings on steel and the like. The composition of the cleaning agent preferably in gel form is tailored such that it is reactive to the adhered material and has no reaction with the tooling material, which can be steel or another material suitable for tooling.

It is to be understood that while the present invention has been illustrated and described in relation to potentially preferred embodiments, constructions, and procedures, that such embodiments, constructions, and procedures are illustrative only and that the invention is in no event limited thereto. Rather, it is contemplated that modifications and variations embodying the principals of the invention will no doubt occur to those of skill in the art. It is therefore contemplated and intended that the present invention shall extend to all such modifications and variations as may incorporate the broad aspects of the invention within the true spirit and scope thereof.

The invention claimed is:

1. A method of cleaning adhered non-ferrous metal build-up present after deformation of a work piece from a deformation tool, the method comprising the steps of:

(a) applying a solution of caustic material directly to the surface of the deformation tool so as to contact the adhered non-ferrous metal build-up;

(b) holding the solution of caustic material in place across the surface of the deformation tool for approximately 5 minutes to substantially dislodge the adhered non-ferrous metal build-up from the surface of the deformation tool, wherein the solution of caustic material is applied using a saturated cloth held in place across the deformation tool;

(c) optionally applying ultrasonic vibration to the solution of caustic material during the holding step; and (d) neutralizing or removing the caustic material.

2. The method according to claim 1 wherein the solution of caustic material is in the form of a gel.

3. The method according to claim 1 wherein the solution of caustic material comprises NaOH.

4. The method according to claim 1 wherein the solution of caustic material comprises KOH.

5. The method according to claim 1 wherein the solution of caustic material comprises an acid selected from the group consisting of acetic acid and phosphoric acid.

6. The method according to claim 1 wherein the holding step is performed at temperatures in the range of 50-100° C.

7. A method of cleaning adhered non-ferrous metal buildup present after deformation of a work piece from a steel stamping tool, comprising the steps of:

(a) applying a solution of caustic material directly to the surface of the steel stamping tool so as to contact the adhered non-ferrous metal buildup;

(b) holding the solution of caustic material in place across the surface of the steel stamping tool for approximately 5 minutes to substantially dislodge the adhered non-ferrous metal buildup from the surface of the steel stamping tool, wherein the solution of caustic material is applied using a saturated cloth held in place across the steel stamping tool;

(c) applying ultrasonic vibration to the solution of caustic material during the holding step; and (d) neutralizing or removing the caustic material.

8. The method according to claim 7 wherein the metal buildup comprises aluminum.

9. The method according to claim 7 wherein the metal buildup comprises magnesium.

10. The method according to claim 7 wherein the metal buildup comprises titanium.

11. The method according to claim 7 wherein the solution of caustic material is in the form of a gel.

12. The method according to claim 7 wherein the solution of caustic material comprises NaOH.

13. The method according to claim 7, wherein the solution of caustic material comprises KOH.

14. The method according to claim 7 wherein the solution of caustic material comprises an acid selected from the group consisting of acetic acid and phosphoric acid.

15. The method according to claim 7 wherein the holding step is performed at temperatures in the range of 50-100° C.

16. A method of cleaning adhered non-ferrous metal buildup present after deformation of a work piece from a steel stamping tool, comprising the steps of:

(a) applying a solution of caustic material directly to the surface of the steel stamping tool so as to contact the adhered non-ferrous metal buildup;

(b) holding the solution of caustic material in place in substantially static relation across the surface of the steel stamping tool for approximately 5 minutes to substantially dislodge the adhered non-ferrous metal buildup from the surface of the steel stamping tool, wherein the solution of caustic material is applied using a saturated cloth held in place across the steel stamping tool; and (c) neutralizing or removing the caustic material, wherein the adhered non-ferrous metal buildup comprises aluminum and wherein the holding step is performed at temperatures in the range of 50-100° C.

17. The method according to claim 16 wherein the solution of caustic material is in the form of a gel.

* * * * *